US007505871B2

(12) United States Patent
Grant et al.

(10) Patent No.: US 7,505,871 B2
(45) Date of Patent: Mar. 17, 2009

(54) DIAGNOSIS AND TROUBLESHOOTING FOR ABOVE-GROUND WELL SYSTEMS

(75) Inventors: James Simspon Grant, Houston, TX (US); Randy Lee Scates, LaMarque, TX (US); James Cavitt Garrett, Kingwood, TX (US); Jeff A Lambert, Conroe, TX (US); Marco Antonio Calzada, Angleton, TX (US); Guy Lamonte McClung, III, Spring, TX (US)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 11/825,318

(22) Filed: Jul. 5, 2007

(65) Prior Publication Data

US 2008/0040065 A1 Feb. 14, 2008

Related U.S. Application Data

(60) Provisional application No. 60/837,251, filed on Aug. 11, 2006.

(51) Int. Cl.
*G06F 19/00* (2006.01)
*G06F 17/40* (2006.01)

(52) U.S. Cl. ..... 702/185; 166/66; 340/500; 340/679; 702/33; 702/34; 702/35; 702/113; 702/182; 702/183; 702/187; 702/189

(58) Field of Classification Search ..... 340/500, 340/511, 665, 679, 680; 702/1, 33, 34, 35, 702/108, 113, 127, 182, 183, 184, 185, 186, 702/187, 188, 189; 166/66; 254/1
See application file for complete search history.

(56) References Cited

U.S. PATENT DOCUMENTS 2,581,721 A * 1/1952 Sherwood ..... 173/20
2,883,255 A * 4/1959 Anderson ..... 346/34
3,102,434 A * 9/1963 Cramer, Jr. ..... 477/110
3,226,977 A * 1/1966 Kolb ..... 73/769
3,517,553 A * 6/1970 Williams et al. ..... 73/152.22
4,477,901 A * 10/1984 Braband et al. ..... 714/46
4,591,006 A 5/1986 Hutchison et al. ..... 175/52
4,724,429 A * 2/1988 Millen et al. ..... 340/679
5,036,479 A * 7/1991 Prednis et al. ..... 702/121
5,272,704 A * 12/1993 Tong et al. ..... 714/26
5,329,465 A 7/1994 Arcella et al. ..... 364/551.01
5,441,110 A 8/1995 Scott, III ..... 166/308
5,557,549 A * 9/1996 Chang ..... 702/183
5,711,382 A 1/1998 Hansen et al. ..... 175/52
5,988,299 A 11/1999 Hansen et al. ..... 175/52
6,003,598 A 12/1999 Andreychuk ..... 166/76.1
6,012,016 A 1/2000 Bilden et al. ..... 702/12
6,377,189 B1 4/2002 Newman ..... 340/854.6
6,408,953 B1 6/2002 Goldman et al. ..... 175/39
6,449,567 B1 * 9/2002 Desai et al. ..... 702/58

(Continued)

FOREIGN PATENT DOCUMENTS

GB 2 191 804 A 5/1985

(Continued)

*Primary Examiner*—Edward R Cosimano
(74) *Attorney, Agent, or Firm*—Guy McClung

(57) ABSTRACT

Systems and methods for diagnosing faults in well servicing operations and determining appropriate remedial action to remedy such faults.

9 Claims, 11 Drawing Sheets

RESULT MATRIX

| SYSTEM STATUS | JOYSTICK (INPUT TO PLC) | ENGINE (SPEED OUTPUT FROM PLC) | ENGINE RPM (FROM SENSOR TO PLC) | ENGINE SOUND | ACTION |
|---|---|---|---|---|---|
| WITH THE ENGINE STOPPED, THE CONTROL SYSTEM SWITCHED ON AND THE JOYSTICK MOVED TO THE LEFT OR RIGHT. | 0 | 0 - 2 | 0 | IDLING | CHECK ENGINE RPM PROXIMITY SENSOR FOR PROPER ALIGNMENT AND OPERATION. CHECK SENSOR CABLE, WIRING AND CONNECTIONS. |
| WITH THE ENGINE STOPPED, THE CONTROL SYSTEM SWITCHED ON AND THE JOYSTICK MOVED TO THE LEFT OR RIGHT. | 0 - 10 TRACKING JOYSTICK | 0 - 10 TRACKING JOYSTICK | 0 | NONE | NONE. THIS INDICATES THAT JOYSTICK AND PLC ARE GOOD |
| WITH THE ENGINE STOPPED, THE CONTROL SYSTEM SWITCHED ON AND THE JOYSTICK MOVED TO THE LEFT OR RIGHT. | 0 - 10 TRACKING JOYSTICK | 0 | 0 | NONE | CHECK PLC |
| WITH THE ENGINE STOPPED, THE CONTROL SYSTEM SWITCHED ON AND THE JOYSTICK MOVED TO THE LEFT OR RIGHT. | 0 | 0 | 0 | NONE | CHECK JOYSTICK. CHECK CABLES, WIRING AND CONNECTIONS FROM OPERATORS CONSOLE TO PLC |

BX

MISSING OR PROBLEM SIGNAL

U.S. PATENT DOCUMENTS

| | | | | |
|---|---|---|---|---|
| 6,519,568 | B1 | 2/2003 | Harvey et al. | |
| 6,693,553 | B1 | 2/2004 | Ciglenec et al. | 340/853.1 |
| 6,907,375 | B2 | 6/2005 | Guggari et al. | 702/113 |
| 2002/0007237 | A1 * | 1/2002 | Phung et al. | 701/33 |
| 2002/0018399 | A1 | 2/2002 | Schultz et al. | 367/81 |
| 2002/0035551 | A1 | 3/2002 | Sheerwin et al. | 705/412 |
| 2003/0168257 | A1 | 9/2003 | Aldred et al. | 175/24 |
| 2004/0026076 | A1 | 2/2004 | Goodwin et al. | 166/66.6 |
| 2004/0065439 | A1 | 4/2004 | Tubel et al. | 166/250 |
| 2005/0279532 | A1 | 12/2005 | Ballantyne et al. | 175/40 |
| 2006/0047527 | A1 | 3/2006 | Caveny et al. | 705/1 |
| 2006/0095230 | A1 * | 5/2006 | Grier et al. | 702/183 |
| 2006/0142910 | A1 * | 6/2006 | Grier et al. | 701/29 |

FOREIGN PATENT DOCUMENTS

| | | | |
|---|---|---|---|
| JP | 4-291428 A | * | 10/1992 |
| WO | WO 98/57030 | | 5/1998 |
| WO | WO 01/29370 A1 | | 10/2000 |

* cited by examiner

FIG. 4
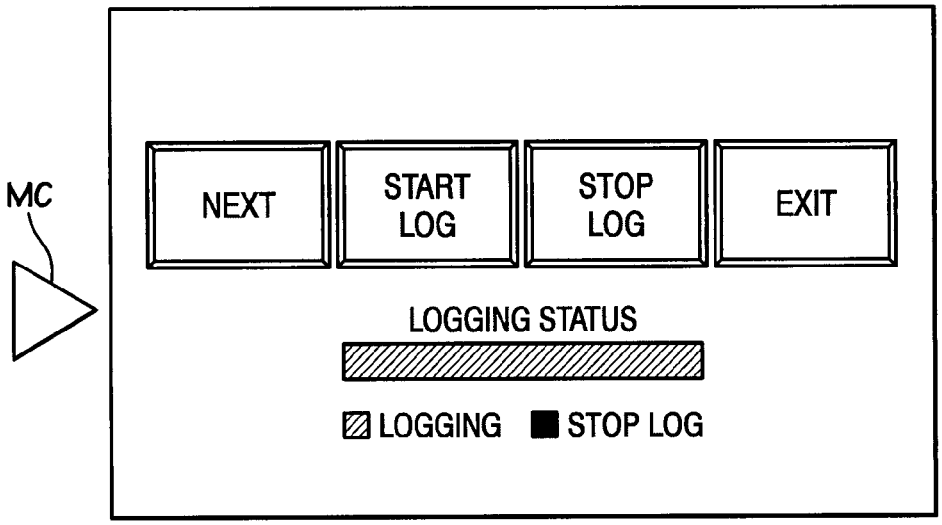
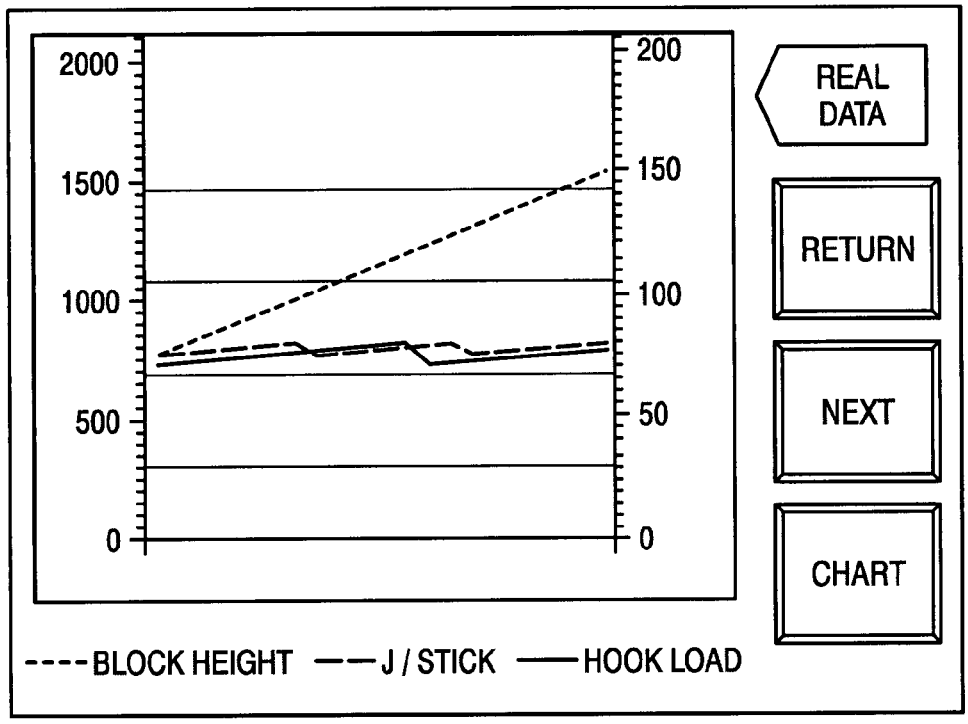
FIG. 5

FIG. 5A

RESULT MATRIX

| SYSTEM STATUS | JOYSTICK (INPUT TO PLC) | ENGINE (SPEED OUTPUT FROM PLC) | ENGINE RPM (FROM SENSOR TO PLC) | ENGINE SOUND | ACTION |
|---|---|---|---|---|---|
| WITH THE ENGINE STOPPED, THE CONTROL SYSTEM SWITCHED ON AND THE JOYSTICK MOVED TO THE LEFT OR RIGHT. | 0 | 0 - 2 | 0 | IDLING | CHECK ENGINE RPM PROXIMITY SENSOR FOR PROPER ALIGNMENT AND OPERATION. CHECK SENSOR CABLE, WIRING AND CONNECTIONS. |
| WITH THE ENGINE STOPPED, THE CONTROL SYSTEM SWITCHED ON AND THE JOYSTICK MOVED TO THE LEFT OR RIGHT. | 0 - 10 TRACKING JOYSTICK | 0 - 10 TRACKING JOYSTICK | 0 | NONE | NONE. THIS INDICATES THAT JOYSTICK AND PLC ARE GOOD |
| WITH THE ENGINE STOPPED, THE CONTROL SYSTEM SWITCHED ON AND THE JOYSTICK MOVED TO THE LEFT OR RIGHT. | 0 - 10 TRACKING JOYSTICK | 0 | 0 | NONE | CHECK PLC |
| WITH THE ENGINE STOPPED, THE CONTROL SYSTEM SWITCHED ON AND THE JOYSTICK MOVED TO THE LEFT OR RIGHT. | 0 | 0 | 0 | NONE | CHECK JOYSTICK. CHECK CABLES, WIRING AND CONNECTIONS FROM OPERATORS CONSOLE TO PLC |

MC

BX

MISSING OR PROBLEM SIGNAL

FIG. 6

RESULT MATRIX

| SYSTEM STATUS | JOYSTICK (INPUT TO PLC) | ENGINE (SPEED OUTPUT FROM PLC) | ENGINE RPM (FROM SENSOR TO PLC) | ENGINE SOUND | ACTION |
|---|---|---|---|---|---|
| WITH THE ENGINE STOPPED, THE CONTROL SYSTEM SWITCHED ON AND THE JOYSTICK MOVED TO THE LEFT OR RIGHT. | 0 | 0 - 2 | 0 | IDLING | CHECK ENGINE RPM PROXIMITY SENSOR FOR PROPER ALIGNMENT AND OPERATION. CHECK SENSOR CABLE, WIRING AND CONNECTIONS. |
| WITH THE ENGINE STOPPED, THE CONTROL SYSTEM SWITCHED ON AND THE JOYSTICK MOVED TO THE LEFT OR RIGHT. | 0 - 10 TRACKING JOYSTICK | 0 - 10 TRACKING JOYSTICK | 0 | NONE | NONE. THIS INDICATES THAT JOYSTICK AND PLC ARE GOOD |
| WITH THE ENGINE STOPPED, THE CONTROL SYSTEM SWITCHED ON AND THE JOYSTICK MOVED TO THE LEFT OR RIGHT. | 0 - 10 TRACKING JOYSTICK | 0 | 0 | NONE | CHECK PLC |
| WITH THE ENGINE STOPPED, THE CONTROL SYSTEM SWITCHED ON AND THE JOYSTICK MOVED TO THE LEFT OR RIGHT. | 0 | 0 | 0 | NONE | CHECK JOYSTICK. CHECK CABLES, WIRING AND CONNECTIONS FROM OPERATORS CONSOLE TO PLC |

BX

MISSING OR PROBLEM SIGNAL

FIG. 7A

ENGINE ONLY TEST

| | |
|---|---|
| JOYSTICK MICRO SWITCH - | 0 |
| JOYSTICK OUTPUT - | 0 |
| PLC ENGINE THROTTLE - | 2 |
| ENGINE RPM - | 200 |

SCREENSHOT 1

FIG. 7B

ENGINE ONLY TEST

| | |
|---|---|
| JOYSTICK MICRO SWITCH - | 1 |
| JOYSTICK OUTPUT - | 2 |
| PLC ENGINE THROTTLE - | 6 |
| ENGINE RPM - | 1500 |

SCREENSHOT 2

FIG. 7C

ENGINE ONLY TEST

| | |
|---|---|
| JOYSTICK MICRO SWITCH - | 1 |
| JOYSTICK OUTPUT - | 10 |
| PLC ENGINE THROTTLE - | 10 |
| ENGINE RPM - | 2100 |

SCREENSHOT 3

DIAGNOSIS AND TROUBLESHOOTING FOR ABOVE-GROUND WELL SYSTEMS

CROSS REFERENCE TO RELATED APPLICATIONS

This application and the present invention claim the benefit under the Patent Laws of expired U.S. application Ser. No. 60/837,251 filed Aug. 11, 2006 entitled "Diagnosis and Troubleshooting For Well Systems."

BACKGROUND OF THE INVENTION

1. Field of the Invention

The present invention is directed to well operations systems and operations and to well servicing systems and operations; and, in certain particular aspects, to fault diagnosis and troubleshooting of such systems and operations, particularly, regarding non-downhole apparatuses.

2. Description of Related Art

The prior art discloses a wide variety of well servicing systems and operations; for example, and not by way of limitation, the systems, devices, apparatuses, and methods disclosed in U.S. Pat. Nos. 4,591,006; 5,988,299; 5,711,382; 6,003,598; 6,377,189; 6,907,375 and in pending U.S. application Ser. No. 10/929,285 filed Aug. 30, 2004, all of said patents and application incorporated fully herein for all purposes.

Once a well has been completed and is operating to extract material from within the earth—e.g. petroleum, gas, hydrocarbons, water or other fluid—various service operations are periodically performed to maintain the well which utilize above-ground devices, systems, and apparatuses. Such service operations may include e.g.: acidizing, fracturing, pumping sand, replacing worn parts such as a pump, sucker rods, inner tubing, and packer glands; pumping chemical treatments or hot oil down into the well bore; tubing services; workovers; milling; setting packers; plug and abandonment operations; and pouring cement into the well bore to partially close off a portion of the well (or to shut it down entirely). Maintenance or service operations can be performed by a well servicing rig, mobile rig, or by a workover rig, swab rig, or a service vehicle having special servicing equipment.

One particular prior art system useful in well servicing operations, provided by National Oilwell Varco is the KINETIC ENERGY CONTROL SYSTEM (described, e.g. in National Oilwell Varco Document No. SO 22277-0501-OPM-001; pp. 4-31) that has PLC-based instrumentation and controls that increase the functionality of a rig's engine, drawworks clutch and brakes. With such systems there is electric rather than hydraulic/pneumatic operation of the drawworks, engine, and brakes which requires less physical exertion by an operator. The system provides alarms and monitoring of selected rig parameters to enable the operator to make more informed decisions. Stainless steel NEMA 4× enclosures are used which are suitable for hazardous area use (where necessary) and resilient mountings protect against shock and vibration.

One prior art version of the KECS system, the KECS—0002 version, provides a fault finding procedure with two basic steps: (1) basic inspection and testing of components and wiring and (2) software interrogation which requires plugging in a laptop computer into a system's PLC ("programmable logic controller") and interrogating the software. In certain aspects, the first step is done by a competent electrician. The second step is done, e.g., by a software engineer with knowledge of the system and the software code.

The present inventors have discovered that it would be beneficial to use such a system for diagnosis and fault finding without requiring an operator's knowledge of the software code and without actually accessing that code.

BRIEF SUMMARY OF THE PRESENT INVENTION

The present invention, in at least certain aspects, provides a method for diagnosis of a well servicing system and of methods of its use which make it possible for on-site personnel not particularly skilled in electrical systems or in software troubleshooting to easily find and diagnose faults in the system and to troubleshoot those faults. In certain aspects, the present invention provides such methods and systems to implement them that include continuous real-time monitoring and, in certain aspects, display of various system and operational parameters so that problems can be recognized and easily dealt with out knowledge of the software code used in computerized controllers and/or PLC's used with the system and without directly accessing the software code.

The present invention, in certain aspects, discloses systems and methods for well operations, in one aspect well servicing operations, the method in certain embodiments including: monitoring a parameter related to a well operations function or to a well servicing function and/or monitoring multiple such parameters, displaying values of the parameter(s); based on said values, determining in real-time if a fault exists related to said well operations function or to said well servicing function; and correlating said values with suggested remedial action to deal with said fault. In such systems and methods, wherein a control system with computer software controls an element of a well operations function or a well servicing apparatus which provides the function, an operator determines if a fault exists without accessing the computer software and determines a possible remedial action without accessing the software. In certain aspects the displaying is done by a display system that has a screen for displaying information, the display system in communication with a control system, the display system for receiving data from the control system related to the parameter related to the well servicing function, and the display system for processing the data received from the control system to produce values of the parameter(s).

Such a system according to the present invention can provide continuous real-time monitoring and display of selected parameter values and control system data and can log chosen critical parameters. In certain aspects, a display provides a real time log of specific selected rig operating parameters to assist in dealing with intermittent system problems and also provides an accessible historical record of system parameters and operation in the event of any incident (e.g., but not limited to, when a travelling block hits the rig floor, there is a log of pertinent parameters, e.g. speed of the block, weight hanging from the block, system calibration, over-pull, or control positions). This information is, optionally, downloadable from a display system onto a memory device, e.g., a memory card or drive and/or into a computer, laptop computer, PC, desktop or other computer (on site or remote) for further analysis and long term storage if desired. Optionally, such methods include accessing and reviewing past parameter values and equipment conditions (e.g., but not limited to, with a display system screen "scroll back" OR "Previous" screen function).

In certain particular aspects, elements for the system (e.g. one or more PLC's; safety barriers; power supply; terminals; thermostat; switches; cables; connections; and/or heater) are installed inside a system PLC control cabinet fitted with mounting hardware to accommodate a display screen, e.g., a 5" Logging Display or a 10" Logging & Diagnostic Display. The display system has suitable power and communication interfaces and connections. In one aspect, the display system is in communication with the PLC, receives data from the PLC, processes the data with software within the display system, and displays (e.g., on screen and/or on strip chart) information related to measured parameter values in real-time. Upon review of parameter values, an operator correlates a value indicative of a fault or problem with suggested action to be taken to remedy the fault or problem (e.g. actions as listed in a list, matrix, or table in a manual or computerized list, etc.).

In certain aspects a system computer or PLC receives information about various rig apparatuses (on rig, off rig, adjacent to the rig, and/or ancillary rig equipment), etc. (e.g. operating parameters of a drawworks engine) via a network such as a PROFIBUS DP network or via a network such as a CanBus network. Diagnostic systems according to the present invention have, in certain aspects, a control system PLC which communicates with a rig operator's controls (e.g. at an operator console, e.g. a driller's controls), and the PLC and the operator's controls can communicate with each other via a network such as a PROFIBUS data processing protocol network or a CanBus protocol network. The PROFIBUS protocol network typically provides an interface between the drawworks engine/transmission and the control system's PLC. By utilizing an appropriate device, e.g. a CanBus J1939 gateway (a device that translates CanBus into Profibus) a logging and a diagnostics system according to the present invention records and utilizes specific engine/transmission information received directly from the engine/transmission (via the gateway; without passing through the PLC) to assist in the fault finding procedure. Information from sensors, controls, engine and/or transmission in its raw form is processed by the PLC and provided to the logging and diagnostic system. On many well service rigs the vehicle and the rig both use the same engine/transmission which uses and can be interrogated with CanBus protocol technology while the rig control system often uses Profibus. The use of a CanBus gateway allows for more system integration.

Systems according to the present invention are useful with mobile rigs, e.g. well servicing rigs, trailered rigs, workover rigs, swabbing rigs, and with small drilling rigs on wheels and rigs movable from one site to another.

Accordingly, the present invention includes features and advantages which are believed to enable it to advance well servicing fault diagnosis and remedial action technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain embodiments of the invention, there are other objects and purposes which will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, non-obvious systems and methods for diagnosing faults and problems associated with well servicing operations and determining appropriate remedial action, particularly with respect to above-ground apparatuses, etc.; and Such systems and methods which do not require an operator to access software code.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWING

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 4 is a front view of a screen of a display system according to the present invention.

FIG. 5 is a front view of a screen of a display system according to the present invention.

FIG. 5A is a front view of a screen of a display system according to the present invention.

FIG. 6 is a table for use with systems according to the present invention.

FIG. 7A is a front view of a screen of a display system according to the present invention.

FIG. 7B is a front view of a screen of a display system according to the present invention.

FIG. 7C is a front view of a screen of a display system according to the present invention.

Figure 1A:
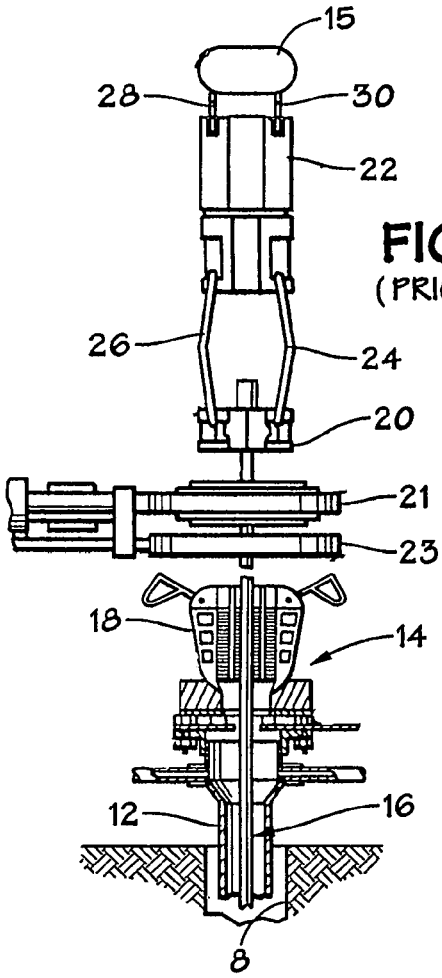
FIG. 1A (PRIOR ART)
FIG. 1A is a side view of a prior art well system.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiments, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

FIG. 1A illustrates a conventional prior art environment in which the system with a well 8 containing a well casing 12 having a well head 14 located at the earth surface. A tubing string 16 extends down the well through the well head and through tubing hanging slips 18 (e.g. power operated) positioned on the well head 14. The tubing string is held by means of an elevator 20 which is connected to traveling block 22 by means of elevator links 24 and 26. Hoist cables 28 and 30 connect the traveling block to a hoist 15 (shown schematically). Power tongs 21 and back-up 23 are located above well head 14 to disconnect or to connect threaded tubing sections into the tubing string.

Figure 1:
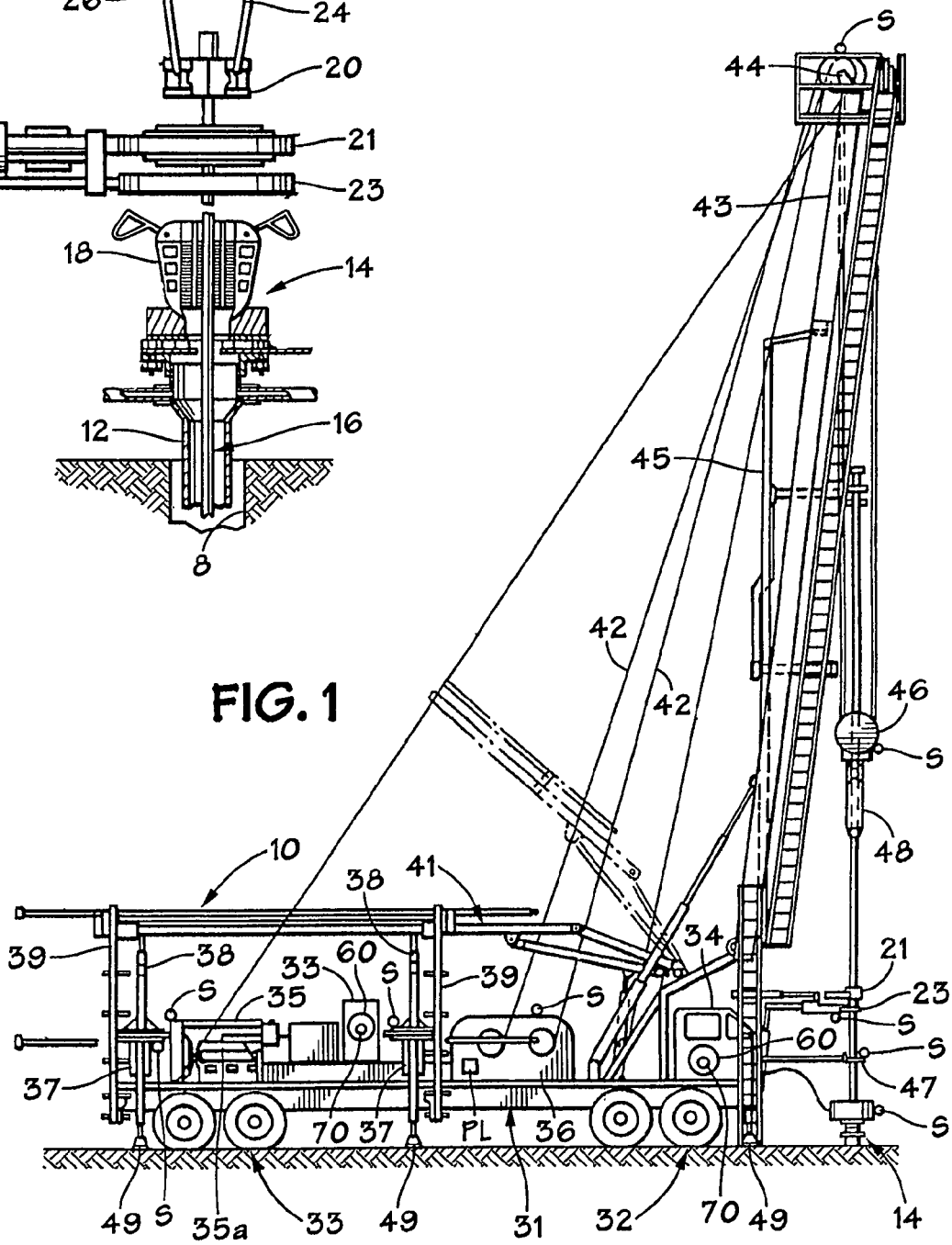
FIG. 1 is a side schematic view of a system according to the present invention.
Figure 2:
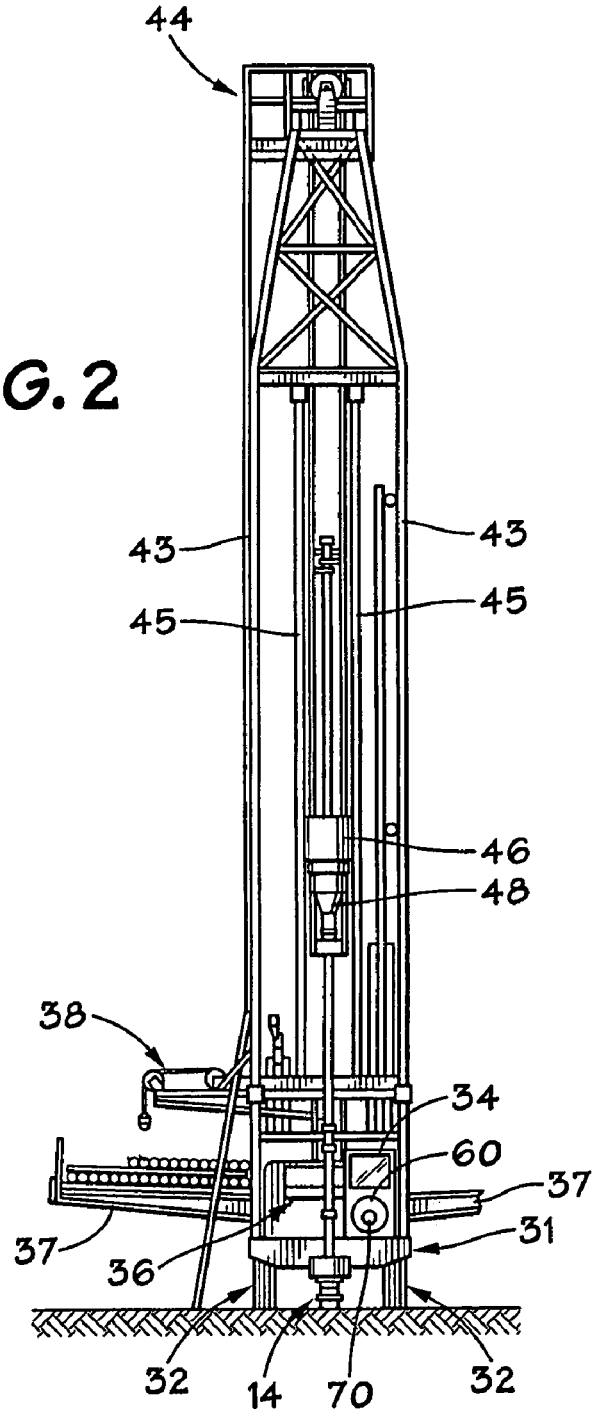
FIG. 2 is an end view of the system of FIG. 1.

In certain aspects, systems and methods according to the present invention are intended for use in the environment shown in FIG. 1A. As illustrated in FIGS. 1 and 2, a system 10 according to the present invention includes a wheeled vehicle 31 having sets of wheels 32 and 33 at the front and rear of the vehicle, respectively. Power systems are provided on the vehicle including a cab at 34 (which can be at either end of a rig) and a power drive system 35 with an engine 35*a* for operating the vehicle and a winching system 36 all of which may be driven from a single power-driven system. It is to be understood that the present invention provides systems for a variety of vehicles and wheeled structures, including, but not limited to, wheeled vehicles and wheeled trailers.

The system 10 includes pipe rack arms 37, a jib crane 38, pipe conveyors 39, transfer arms 41, a hoist cables 42, a derrick 43, a crown block 44, a pipe manipulator 45, a traveling block 46, power tongs 21, back-up tongs 23, a centralizer 47, and an elevator 48. The foregoing equipment is supported on and provided with operating apparatus that is also supported on the vehicle 31. When in operating position, the vehicle is leveled by a set of levelers 49 which engage the earth surface.

A control system 60 according to the present invention includes a logging/diagnostic display system 70 which provides on screen real-time indications of system parameter levels and/or values, changes in them over a specified time period, a "scroll back" ability for viewing past (and recent past) parameter levels and/or values, and gives an operator a visual display of parameter levels and/or values in real-time. The system 60 may use any suitable computer(s) and/or PLC (s). Optionally, the control system 60 and/or display system 70 are in/on a PLC cabinet 33 (and any system according to the present invention herein may have such a PLC cabinet).

Figure 3A:
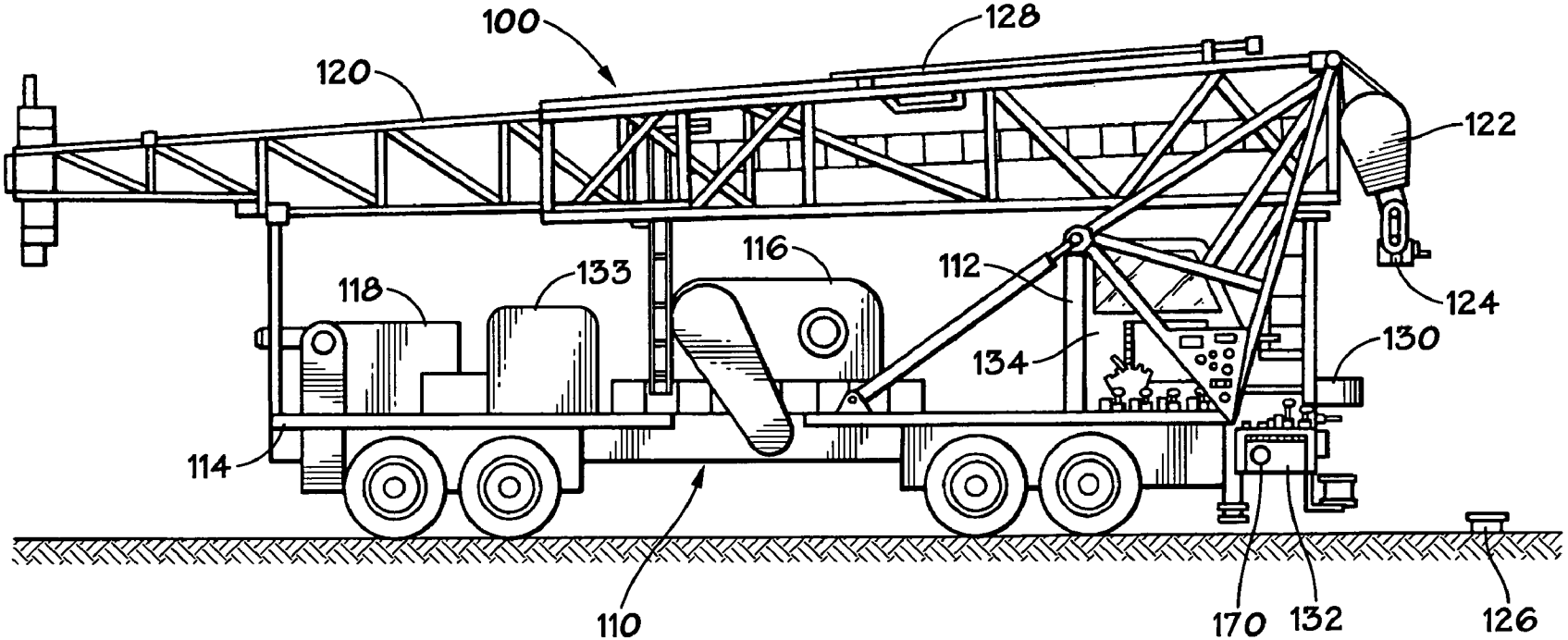
FIG. 3A is a side view of a system according to the present invention.

A system 100 according to the present invention is illustrated in FIG. 3A. The system 100 includes a wheeled vehicle 110, having a cab 134 and a bed 114 for mounting operating equipment. The operating equipment includes a winch or hoisting system 116 and a power drive system 118. The system 100 includes a hydraulically operated derrick 120, having a hoist block 122 and elevator 124, that are shown in a stored position for transport to a well head 126. A racking platform 128 is folded against the side of the derrick 120 for transportation.

Tong assembles 130 are pivotally mounted on the frame of derrick 120, and when not in use, are folded against the forward end of vehicle 110. A control system 132 (like the control system of FIG. 1) for controlling operation of elements of the system 100 including the tong assemblies 130 also has a system 170 (like the system 70, FIG. 1). Optionally, a PLC cabinet 133 (like the PLC cabinet 33, FIG. 1) is used with the display system 170.

The system 100 is driven to a site and positioned adjacent to the well head 126. The derrick 120 is then raised into a vertical position by the hydraulic cylinders 112 and stabilized in the position illustrated in FIG. 3B. The racking platform 128 is then lowered to the position shown in FIG. 3B for receiving and racking tubulars, e.g. pipes, tubing, and/or rods.

Figure 3B:
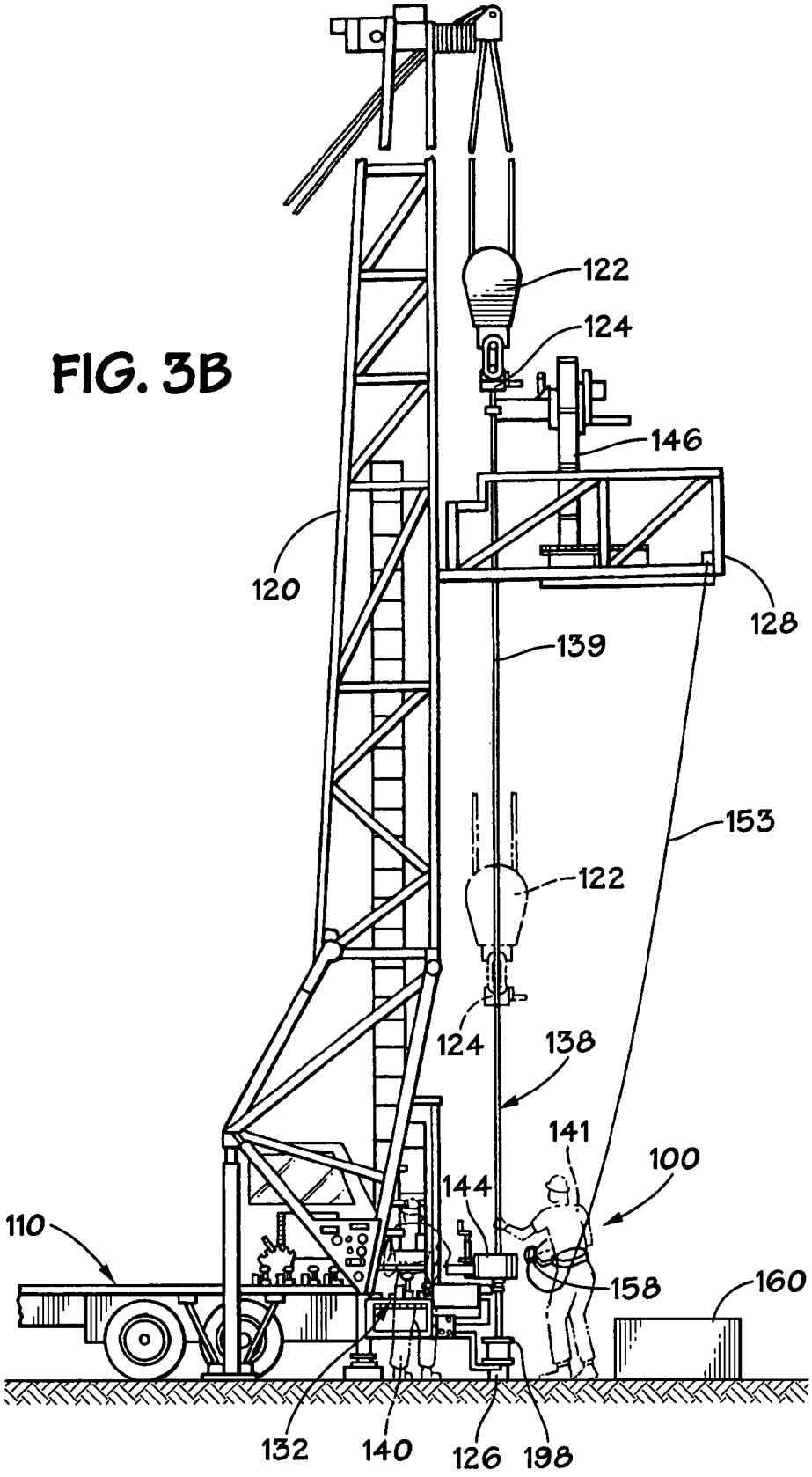
FIG. 3B is a side view of the system of FIG. 3A.

The system 100 as shown in FIG. 3B, is set up for handling rods. A rod string is set in position in rod slips 198 to hold a rod string 138. Rod slips 198 prevent the string from falling back into the well. The hoist 122 and elevator 124 are then lowered close to rod slips 198 and the collar of rod string 138 placed in the elevator 124. The hoist 122 is then lifted to the position shown in FIG. 3B. An operator 140 then presses a momentary switch on the control system 132 to activate the tong assembly 144. Once activated, the tong assembly 144 moves forward to grip the junction between adjacent rods in the rod string 138, disconnects or connects adjacent rods, and then retracts. It is to be understood that it is within the scope of the present invention to provide systems according to the present invention for use with rigs that handle rods and/or tubulars, e.g. tubing. Certain gas wells and oil wells under a sufficient gas head do not contain rods, in some situations more tubing is handled than rods, depending on the type of fields, etc. Also, since tubing is much larger, pulling tubing is slower and making and breaking joints requires more effort for tubing, therefore, more of a rig's lifetime is spent pulling tubing than rods.

Figure 3C:
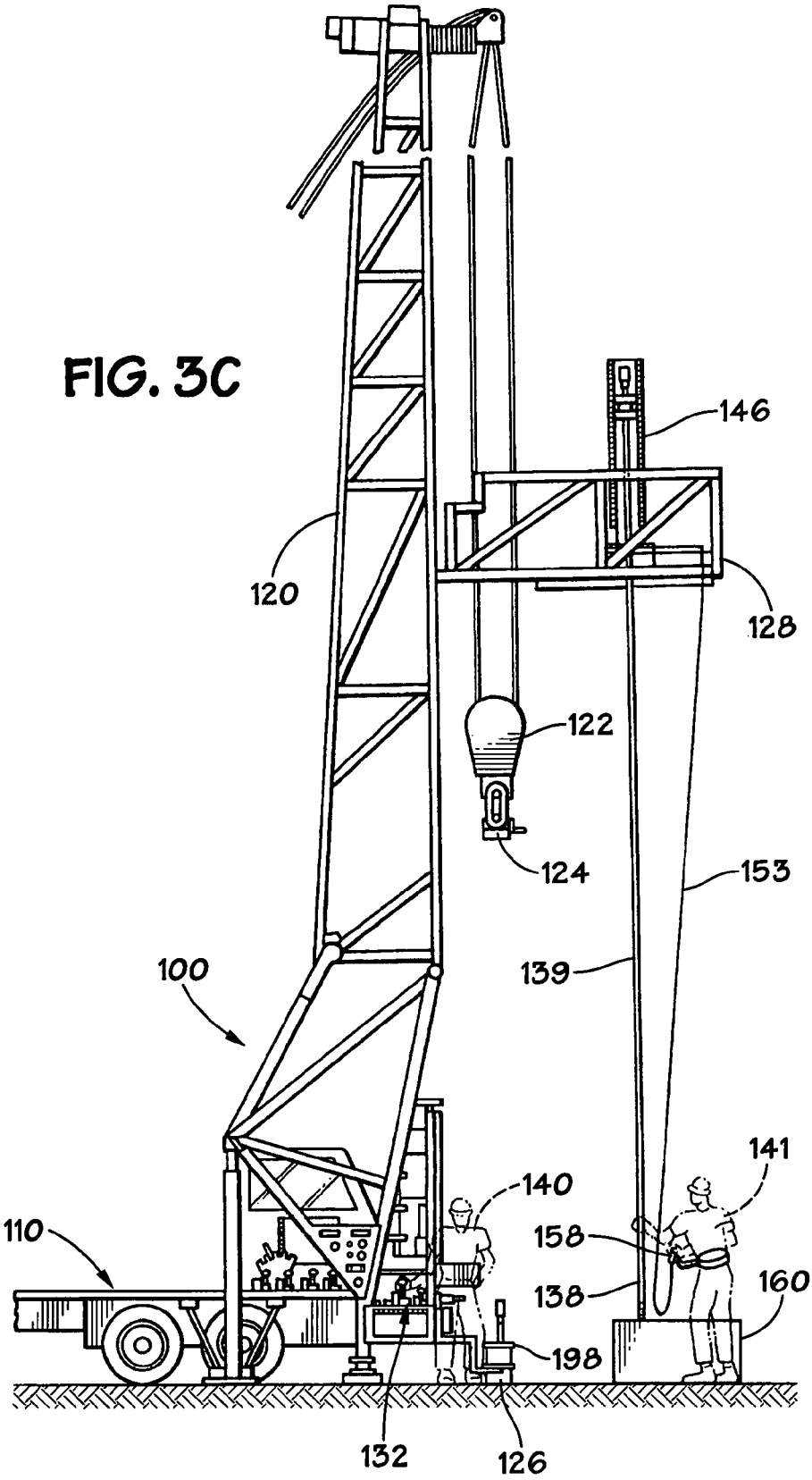
FIG. 3C is a side view of the system of FIG. 3A.

Once an upper rod 139 is detached from the rod string 138, the elevator and blocks are lowered and a floor man 141 can manipulate a robotic rod and pipe handler 146 by a waist mounted control (optionally in communication with the control system 132) or joy stick 158 connected by cable 153. The floor man 141 advances the handler 146 and grips the detached rod 139 after the hoist 122 has been lowered below the racking board 128. The hoist block 122 is lowered below the free end of the rod 139 allowing the floor man 141 to manipulate the handler 146 to place the rod in the racking board 128 as shown in FIG. 3C. The free end of rod 139 is allowed to rest on a base 160.

FIG. 4 shows display system's screen according to the present invention (e.g. for a system 70 or a system 170), a start up screen for one embodiment of the present invention (which may be a touch screen). Touch screens with touch screen buttons may be used to navigate through the available screens. In one particular aspect this display screen for a system according to the present invention is a 10" STN touch screen (e.g. Siemens Simatic TP 270). The display includes a removable Secure Digital (SD) memory device or equivalent flash memory card MC (shown schematically) to allow data to be downloaded from a PLC into a computer for further analysis and storage. The system in one aspect logs approximately seven to ten signals. In one aspect, this data is sampled every second and stored for a period of twenty hours or longer before being overwritten.

As shown in FIG. 4, when it is desired to view levels or values of other operation parameters, pushing the "Next" button reveals the next screen. Pushing the "Start Log" button instructs the display system to begin logging (recording) data from the PLC and processing it (the display system includes its own data processor, computer, and/or PLC). Pushing the "Stop Log" button instructs the display system to cease logging (recording) data from the PLC. Pushing the "Exit" button exits the display system program. The "Logging Status" bar indicates whether the system is receiving data ("logging") or has ceased doing this ("Stop Log").

In certain embodiments there are a minimum of seven screens available on the display, including approximately four diagnostic screens. Digital values are shown as 0 or 1; analog values are shown as numeric values on the diagnostic screens. One, two, or more logging screens show information in line graph format.

The logging screen(s) may, e.g., show selected values from the following parameter list:

Joystick Position
Joystick Dead Man Switch Position
PLC Brake Output value
Brake System Pressure
PLC Drawworks Clutch Output
Rig Engine RPM (e.g. engine 35, FIG. 1)
Block Height
Block Speed
Hook Load
Over Ride Push Button Position
Mode Switch Position (e.g. modes of a KECS™ system)

FIG. 5 shows a typical logging screen which, illustrates graph lines in real-time for three system parameters. The lower horizontal axis is a time axis. For example, one graph line indicates the height of the rig's travelling block ("Block-Height"); one graph line indicates the position of an operator's joystick ("J/Stick"); and one graph line indicates hook load ("HookLoad").

As shown in FIG. 5, when it is desired to view historical levels or values of operational parameters, pushing the "Return" button scrolls the display backwards chronologically. Pushing the "Next" button scrolls the display forwards chronologically. The "Real Data" indicator at the top of the screen indicates when real time levels or values are being displayed. "Operational parameters" may include parameters regarding any equipment, apparatus, and devices discussed above and/or referred to and/or shown in the drawing figures and/or to any ancillary rig equipment, apparatus and device on or near a rig.

Figure 7D:
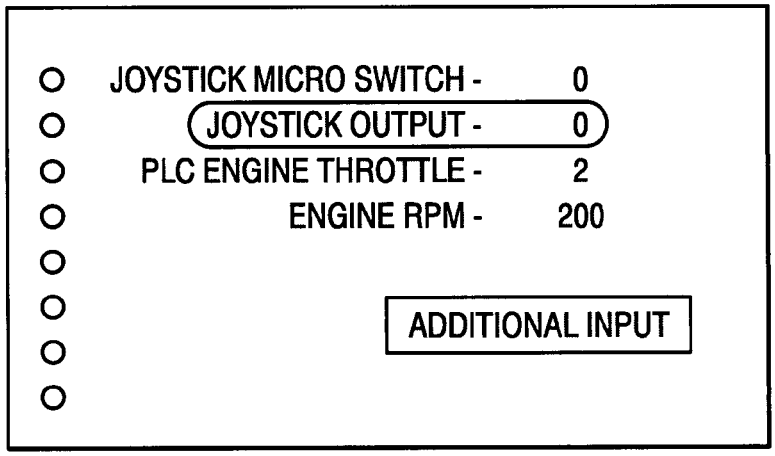
FIG. 7D is a front view of a screen of a display system according to the present invention.

The data represented on the logging screen(s) is obtained from sensors (e.g. sensors S, FIG. 1, shown schematically) on each element of a rig which are in communication with the control system computer or PLC. In certain aspects, these screens show selected parameter values grouped by functionality. For example, parameters associated with raising the block or engine only (auxiliary equipment operation) are shown on the same screen. These diagnostic screens are used in conjunction with a fault finding manual or screen display to simplify the fault finding procedure. Examples of these screens can be seen in FIGS. 7A-7C.

Suitable communication cables for interface with a drawworks control PLC ("PL", FIG. 1) and other system sensors and elements provide communication with the control system. In certain aspects the display system operating ambient temperature is −40° C. to +40° C. and system operating ambient humidity is 90% (non-condensing). In certain aspects, the PLC cabinet 33 (or 133) has one or more heaters for colder environments.

The fault finding protocols and procedures are available in hard copy and/or physical papers or manuals which contain criteria, tables and steps for fault finding and trouble shooting procedures, e.g. procedures related to rig functionality such as "raising the blocks" and "engine only" (tong/utility winch) operation, etc.; or these are presented on screen. These procedures, the manual, and its lists, matrices, tables, etc. and the diagnostic display screens assist with fault finding of specific recurring problems. This can be done following a study of historical rig problem data. In certain aspects the manual (or screen display) contains descriptions of each functionality based test; a matrix of possible test results with remedial actions; and examples of screen displays (screen shots) seen during each specific test.

In one particular aspect, in a fault finding format according to the present invention, a test is performed of auxiliary equipment, an engine only test. With the engine idling, the control system switched on, and the joystick at rest, a basic engine control diagnostic screen looks like screenshot 1 (FIG. 7A). As the joystick is moved, e.g. left or right, a joystick signal starts to rise and both the engine throttle and RPM values increase as shown in Screenshot 2 (FIG. 7B). The engine speed is heard increasing. With the joystick fully to the left or right, all signals should be at or near maximum as shown in Screenshot 3 (FIG. 7C) and the engine noise should indicate high RPM. When moving the joystick slowly left or right, all signals should increase and decrease (track) together. If any signal is missing or not tracking, a fault finding chart (e.g. see FIG. 5A or FIG. 6) is used to determine the existence of a fault. This chart can be in a printed paper manual (FIG. 6) or presented in a screen of the display system (e.g. by pushing or touching the "Chart" button, FIG. 5, producing a screen as in FIG. 5A). Absence of the joystick or engine throttle signals may stop the engine from running. For example, if the value for "Joystick Output", in Screenshot 3 is zero, an operator goes to the Result Matrix (FIG. 5A or FIG. 6) and looks in the box which indicates a "0" in the Joystick column. This is box "BX" in FIG. 6. The operator then checks the corresponding "Action" column to determine what action is to be taken—in this case "Check joystick". Similarly for any box indicating a zero value (a "Missing or problem signal" box), an operator locates the correct box and then sees what action is indicated in a corresponding "Action" box. The "Engine Status" boxes indicate a variety of possible statuses for the rig engine.

It is within the scope of the present invention, in particular aspects, to automatically provide an indication of a possible remedial action to be taken when the display system displays a parameter value indicating a fault or possible fault in an operational function. In one aspect, for example, on a tubular screen (e.g. the screen of FIG. 7A) the operator pushes (touches) a line (e.g. "Joystick Output O") and the next screen display is the "Action" box or boxes from a list or test results matrix (e.g. as in FIG. 6) (e.g. the operator touches "Joystick Output O") and the next screen displays the top and the bottom boxes from the "Action" column of FIG. 6. The operator knows the engine is either idling or silent and chooses the action listed corresponding to this Engine Sound.

Figure 7E:
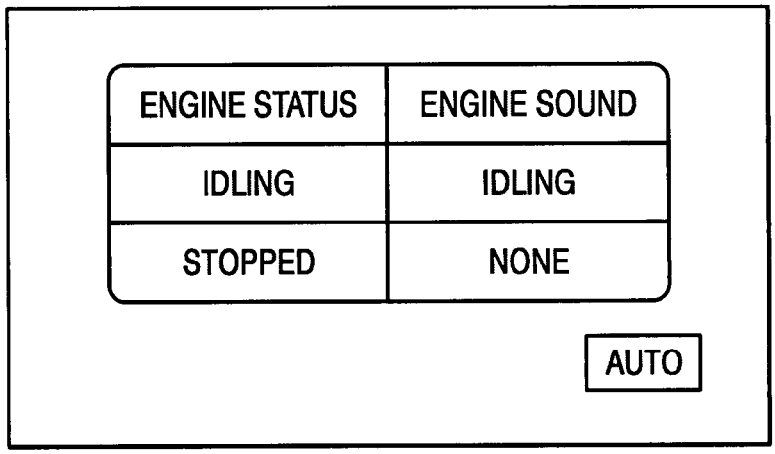
FIG. 7E is a front view of a screen of a display system according to the present invention.
Figure 7F:
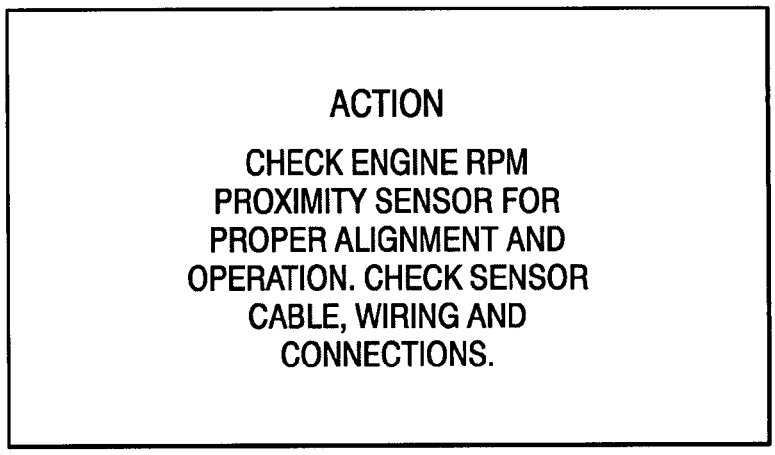
FIG. 7F is a front view of a screen of a display system according to the present invention.

In another aspect, the operator touches a line indicating a potential fault (e.g. the line "Joystick Output O" in FIG. 7D) and then touches the "Additional Input" button. The next screen asks for additional information before the system automatically displays the remedial action to be taken. For example, after touching the "Joystick Output O" line of FIG. 7D, the operator views the next screen as shown in FIG. 7E and touches "Idling" in the "Engine Status" column and "Idling" in the "Engine Noise" column. Either automatically or upon touching the "Auto" button, the display system displays screen 7F which shows the suggested remedial action.

Automatic suggested action display can be done with respect to any of the fault-indicating values for any parameter.

Each PLC, computer, control system, and display system herein includes computer readable media containing appropriate executable instructions that when executed by the PLC, computer, control system or display system implement a method to accomplish the desired function or effect and computer programs used in said PLC, etc. comprise logic for accomplishing said function or effect.

With such systems according to the present invention, an operator need only access displayed data and use the fault finding protocols to determine that a fault exists and to determine possible remedial action. This operator does not need to have any intimate knowledge of the control system's software code nor does the operator need to actually access this code to find a fault and to learn actions to take to remedy the fault.

Figure 8B:
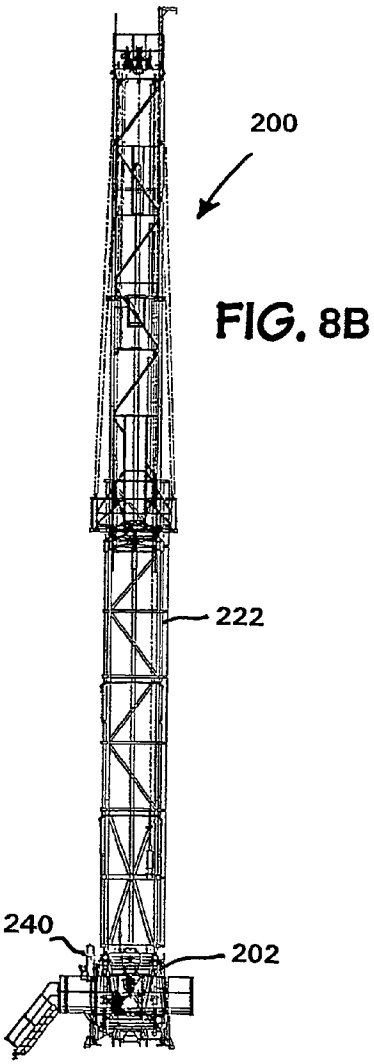
FIG. 8B is an end view of the rig of FIG. 8A.
Figure 8A:
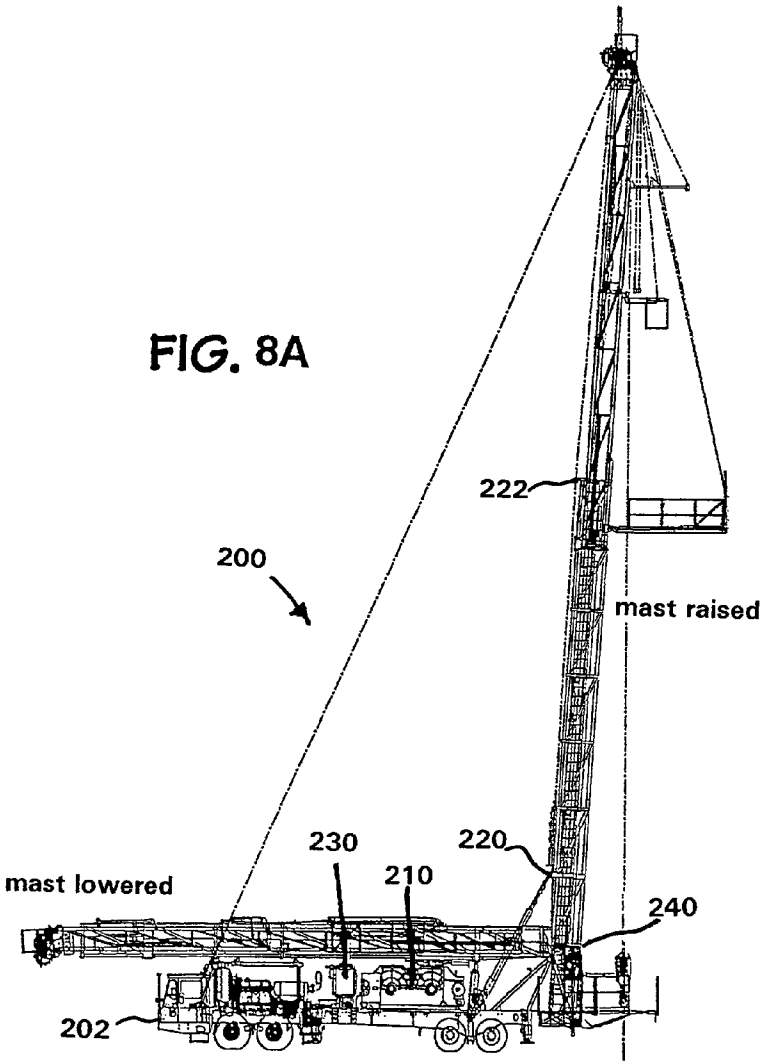
FIG. 8A is a side view of a rig according to the present invention.

FIGS. 8A and 8B show a rig 200 according to the present invention with a wheeled vehicle 202 and a derrick system 220 (e.g. like the derrick 120). The rig 200 has a logging and diagnostic system 210 according to the present invention which receives data from a PLC 230 (e.g. like the PLC's in the systems of FIG. 1 and FIG. 3A). The PLC 230 receives data from the various on-rig, adjacent-to-the-rig, and/or ancillary equipment which it processes and sends to the system 210. An operator communicates with the system 210 via a console 240 (e.g. a driller's control console).

FIG. 8A shows a mast 222 of the derrick system 220 in both a lowered position ("mast lowered") and a raised position ("mast raised").

The present invention, therefore, provides in at least some embodiments, a method for well servicing operations, the method including: monitoring a parameter related to a well servicing function; displaying a value of the parameter; based on said value determining in real-time if a fault exists related to said well servicing function; and correlating said value with suggested remedial action to deal with said fault. Such a method may include one or some—in any possible combination—of the following: wherein a control system with computer software controls an element of a well servicing apparatus which provides the well servicing function, and an operator determines if a fault exists without accessing the computer software; wherein said correlating includes correlating said displayed value with a suggested remedial action; wherein said suggested remedial action is listed in a hard copy printed item; wherein said suggested remedial action is displayed on a screen; wherein said displaying is done by a display system that has a screen for displaying information; wherein a control system with computer software controls an element of a well servicing apparatus which provides the well servicing function, wherein said displaying is done by a display system that has a screen for displaying information, the display system in communication with the control system, the display system for receiving data from the control system related to the parameter related to the well servicing function, and the method further including the display system processing the data received from the control system to produce the value of the parameter; removably installing a memory device in the display system, and transferring information related to the value of the parameter to the memory device; removing the memory device from the display system, and transferring information from the memory device to another apparatus, e.g. a computer, PLC, laptop, or desktop; wherein a control system controls an element of a well servicing apparatus which provides the well servicing function, wherein said displaying is done by a display system that has a screen for displaying information, the display system in communication with the control system, the display system for receiving data from the control system related to the parameter related to the well servicing function, wherein when a value of a parameter is selected indicative of a fault, the display system automatically displays a suggested remedial action for dealing with the fault; wherein the control system has programmable media with computer software to facilitate control of the element of the well servicing apparatus which provides the well servicing function, and an operator determines if a fault exists without accessing the computer software; wherein a control system controls an element of a well servicing apparatus which provides the well servicing function, wherein said displaying is done by a display system that has a screen for displaying information, the display system in communication with the control system, the display system for receiving data from the control system related to the parameter related to the well servicing function, wherein when a value of a parameter is selected indicative of a fault and additional information about the well servicing operations is entered into the display system, the display system automatically displays a suggested remedial action for dealing with the fault; wherein the control system has programmable media with computer software to facilitate control of the element of the well servicing apparatus which provides the well servicing function, and an operator determines if a fault exists without accessing the computer software; wherein multiple values of the parameter are displayed; wherein multiple parameters are displayed; wherein steps are performed by an operator using a touch screen; wherein the screen is a touch screen; wherein selected parameter values are displayed grouped by functionality; the display includes means for going back to at least one or multiple previous screen displays; and/or in which computers or PLC's used in the method have programmable media programmed to accomplish the appropriate function or functions.

The present invention, therefore, provides in at least some embodiments, a method for well operations, the method including monitoring at least one parameter related to a well operation function, displaying a value of the at least one parameter, based on said value determining in real-time if a fault exists related to said well operation function, and correlating said value with suggested remedial action to deal with said fault.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. What follows are some of the claims for some of the embodiments and aspects of the present invention, but these claims are not necessarily meant to be a complete listing of nor exhaustive of every possible aspect and embodiment of the invention. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for testing a rig engine of a wellbore rig, the engine used in well servicing operations, the method comprising monitoring the revolutions per minute of a rig engine of a well servicing rig, the rig engine controlled by a control system with computer software for controlling the rig engine, displaying on a display a value of the engine's revolutions per minute, based on said value determining in real-time if a fault exists related to said rig engine, said determining done by an operator without accessing the computer software, and correlating said value with suggested remedial action to deal with said fault.

2. The method of claim 1 wherein said suggested remedial action is displayed on a screen.

3. The method of claim 1 wherein said suggested remedial action is listed in a hard copy printed item.

4. The method of claim 1 wherein said displaying is done by a display system that has a screen for displaying information, the display system in communication with the control system, the display system for receiving data from the control system related to the parameter related to the well servicing function, and wherein when a value of a parameter is selected indicative of a fault, the display system automatically displays a suggested remedial action for dealing with the fault.

5. The method of claim 1 wherein a control system controls an element of a well servicing apparatus which provides the well servicing function, wherein said displaying is done by a display system that has a screen for displaying information, the display system in communication with the control system, the display system for receiving data from the control system related to the parameter related to the well servicing function, and wherein when a value of a parameter is selected indicative of a fault and additional information about the well servicing operations is entered into the display system, the display system automatically displays a suggested remedial action for dealing with the fault.

6. The methods of claim 1 done in real-time with a real-time display.

7. The method of claim 1 further comprising manually moving a joystick of a joystick apparatus which is in communication with the control system to increase the engine rig speed, displaying and increase in engine rig speed on the display, if, despite correct movement of the joystick, there is no increase in engine rig speed, determining that an engine operation fault is present and proceeding to the step of correlating said value with suggested remedial action, correlating said displayed value with a suggested remedial action.

8. The method of claim 7 wherein an engine sensor monitors rig engine speed and produces a signal indicative of the speed in revolutions per minute, the engine sensor in communication with the control system via sensor wiring, the control system including a programmable logic controller, and the joystick in communication with the control system via joystick wiring, the method further comprising the suggested remedial action comprising one of check engine sensor, check sensor wiring, check programmable logic controller, and check joystick, and check joystick wiring.

9. A method for testing a rig engine of a wellbore rig, the engine used in well servicing operations, the method comprising monitoring the revolutions per minute of a rig engine of a well servicing rig, the rig engine controlled by a control system with computer software for controlling the rig engine, displaying on a display a value of the engine's revolutions per minute, based on said value determining in real-time if a fault exists related to said rig engine, said determining done by an operator without accessing the computer software, correlating said value with suggested remedial action to deal with said fault, manually moving a joystick of a joystick apparatus which is in communication with the control system to increase the engine rig speed, displaying and increase in engine rig speed on the display, if, despite correct movement of the joystick, there is no increase in engine rig speed, determining that an engine operation fault is present and proceeding to the step of correlating said value with suggested remedial action, correlating said displayed value with a suggested remedial action, wherein an engine sensor monitors rig engine speed and produces a signal indicative of the speed in revolutions per minute, the engine sensor in communication with the control system via sensor wiring, the control system including a programmable logic controller, and the joystick in communication with the control system via joystick wiring, the method further comprising the suggested remedial action comprising one of check engine sensor, check sensor wiring, check programmable logic controller, and check joystick, and check joystick wiring.

* * * * *